US010316787B2

(12) United States Patent
Aso et al.

(10) Patent No.: US 10,316,787 B2
(45) Date of Patent: Jun. 11, 2019

(54) FUEL SUPPLY DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Koji Aso, Toyota (JP); Hideaki Hayashi, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 164 days.

(21) Appl. No.: 15/315,591

(22) PCT Filed: Jun. 18, 2015

(86) PCT No.: PCT/IB2015/000991
§ 371 (c)(1),
(2) Date: Dec. 1, 2016

(87) PCT Pub. No.: WO2015/193723
PCT Pub. Date: Dec. 23, 2015

(65) Prior Publication Data

US 2017/0198657 A1 Jul. 13, 2017

(30) Foreign Application Priority Data

Jun. 19, 2014 (JP) ..... 2014-125924

(51) Int. Cl.
*F02D 41/30* (2006.01)
*F02D 41/32* (2006.01)
*F02D 41/38* (2006.01)

(52) U.S. Cl.
CPC ..... *F02D 41/3094* (2013.01); *F02D 41/32* (2013.01); *F02D 41/38* (2013.01);
(Continued)

(58) Field of Classification Search
CPC ..... F02D 41/3094; F02D 41/38; F02D 41/32; F02D 2200/101; F02D 2200/0602; F02D 2200/0606; F02D 2250/04
(Continued)

(56) References Cited

U.S. PATENT DOCUMENTS

2005/0072405 A1* 4/2005 Kojima ..... F02D 33/003 123/446
2006/0196475 A1 9/2006 Tomoda et al.
(Continued)

FOREIGN PATENT DOCUMENTS

JP 2005-146881 A 6/2005
JP 2006-077643 A 3/2006
(Continued)

OTHER PUBLICATIONS

WO-2010095282-A1—English Translation (Year: 2010).*
English-Language Translation of Dec. 25, 2018 Office Action issued in Chinese Patent Application No. 201580029848.X.

*Primary Examiner* — Joseph J Dallo
*Assistant Examiner* — Scott A Reinbold
(74) *Attorney, Agent, or Firm* — Oliff PLC

(57) ABSTRACT

Provided is a fuel supply device for an internal combustion engine. When fuel pressure in a high-pressure fuel pipe changes as a result of the driving of a high-pressure pump, the changing fuel pressure propagates as pulsation into a low-pressure fuel pipe. A degree of influence of propagation of pulsation decreases as fuel pressure in the low-pressure fuel pipe increases. When the high-pressure pump is in an operating state where the degree of influence of the pulsation of the fuel pressure propagating from the high-pressure fuel pipe on the fuel pressure in the low-pressure fuel pipe is high, boost control for driving a feed pump to raise the fuel pressure in the low-pressure fuel pipe is executed.

9 Claims, 4 Drawing Sheets

(52) U.S. Cl.
CPC ..... *F02D 2200/0602* (2013.01); *F02D 2200/0606* (2013.01); *F02D 2200/101* (2013.01); *F02D 2250/04* (2013.01)

(58) Field of Classification Search
USPC ..... 123/436
See application file for complete search history.

(56) References Cited

U.S. PATENT DOCUMENTS

| | | | | |
|---|---|---|---|---|
| 2007/0006849 | A1 | 1/2007 | Mashiki | |
| 2009/0090331 | A1* | 4/2009 | Pursifull | F02M 37/0058 123/446 |
| 2011/0231082 | A1 | 9/2011 | Saruwatari | |
| 2012/0167859 | A1* | 7/2012 | Basmaji | F02D 19/0605 123/456 |
| 2013/0247874 | A1* | 9/2013 | Saito | F02D 41/3854 123/446 |
| 2016/0090955 | A1* | 3/2016 | Yuasa | F02M 69/046 123/457 |

FOREIGN PATENT DOCUMENTS

| | | | | |
|---|---|---|---|---|
| JP | 2006-242059 | A | 9/2006 | |
| JP | 2007-071082 | A | 3/2007 | |
| JP | 2008-180169 | A | 8/2008 | |
| JP | 2011-196274 | A | 10/2011 | |
| JP | 2012-229623 | A | 11/2012 | |
| JP | 2012-237274 | A | 12/2012 | |
| JP | 5282779 | B2 * | 9/2013 | F02D 41/3854 |
| JP | 5282779 | B2 * | 9/2013 | F02D 41/3854 |
| WO | 2010/095282 | A1 | 8/2010 | |
| WO | WO-2010095282 | A1 * | 8/2010 | F02M 55/04 |

* cited by examiner

FUEL SUPPLY DEVICE FOR INTERNAL COMBUSTION ENGINE

BACKGROUND OF THE INVENTION

1. Field of the Invention

The invention relates to a fuel supply device for an internal combustion engine.

2. Description of Related Art

Japanese Patent Application Publication No. 2012-237274 (JP 2012-237274 A) discloses a fuel supply device for an internal combustion engine in which a low-pressure fuel pipe that receives fuel supply from a feed pump is connected to a first fuel injection valve and a high-pressure fuel pipe that branches from the low-pressure fuel pipe is connected to a second fuel injection valve. In addition, a high-pressure pump that boosts the fuel in the high-pressure fuel pipe and supplies the fuel to the second fuel injection valve is disposed in the device.

In the fuel supply device described above, the low-pressure fuel pipe is connected to the high-pressure pump via the high-pressure fuel pipe. Accordingly, when the fuel pressure in the high-pressure fuel pipe changes as a result of the driving of the high-pressure pump, the changing fuel pressure propagates as pulsation to the fuel in the low-pressure fuel pipe. This causes the pulsation of the fuel pressure in the low-pressure fuel pipe to increase.

An error from a proper value occurs in the fuel injection amount of the first fuel injection valve when the pulsation of the fuel pressure in the low-pressure fuel pipe increases. This is because the fuel injection amount of the first fuel injection valve is determined by the valve opening time of the fuel injection valve and the pressure of the fuel supplied to the fuel injection valve (fuel pressure in the low-pressure fuel pipe). The error of the fuel injection amount of the first fuel injection valve described above may affect the operation of the internal combustion engine.

SUMMARY OF THE INVENTION

In view of this, the invention provides a fuel supply device for an internal combustion engine that is capable of suppressing an increase in the pulsation of the pressure of fuel in a low-pressure fuel pipe which is attributable to the driving of a high-pressure pump.

According to an aspect of the invention, there is provided a fuel supply device for an internal combustion engine. The fuel supply device for an internal combustion engine includes a low-pressure fuel pipe, a high-pressure fuel pipe, a high-pressure pump, and an electronic control unit. The low-pressure fuel pipe is connected to a first fuel injection valve of an internal combustion engine. The low-pressure fuel pipe is configured to receive fuel supplied from a feed pump. The high-pressure fuel pipe branches from the low-pressure fuel pipe. The high-pressure fuel pipe is connected to a second fuel injection valve of the internal combustion engine. The high-pressure pump is configured to boost the fuel in the high-pressure fuel pipe. The high-pressure pump is configured to supply the fuel to the second fuel injection valve. The electronic control unit is configured to execute boost control in an operating state of the high-pressure pump where a degree of influence of pulsation of fuel pressure propagating from the high-pressure fuel pipe on fuel pressure in the low-pressure fuel pipe is high. The boost control is for driving the feed pump and raising the fuel pressure in the low-pressure fuel pipe.

In the fuel supply device, the electronic control unit may be configured to determine that the high-pressure pump is in the operating state when the degree of influence of the pulsation of the fuel pressure is greater than a predetermined value. In addition, in the fuel supply device, the electronic control unit may be configured to increase the fuel pressure in the low-pressure fuel pipe as the degree of influence of the pulsation of the fuel pressure propagating from the high-pressure fuel pipe increases when the high-pressure pump is in the operating state.

When the fuel pressure in the high-pressure fuel pipe changes as a result of the driving of the high-pressure pump, the changing fuel pressure propagates as the pulsation to the fuel in the low-pressure fuel pipe. When the pulsation of the fuel pressure propagates from the high-pressure fuel pipe to the fuel in the low-pressure fuel pipe as described above, the degree of the influence decreases as the fuel pressure in the low-pressure fuel pipe increases. In view of this, the fuel pressure in the low-pressure fuel pipe is raised, through the execution of the boost control by the electronic control unit, when the high-pressure pump is in an operating state where the degree of influence of the pulsation of the fuel pressure propagating from the high-pressure fuel pipe on the fuel pressure in the low-pressure fuel pipe is high according to the fuel supply device for an internal combustion engine described above. When the fuel pressure in the low-pressure fuel pipe is raised, the driving of the high-pressure pump causes the fuel pressure in the high-pressure fuel pipe to change. As a result, the degree of the influence is restricted when the pulsation of the fuel pressure propagates from the high-pressure fuel pipe to the fuel in the low-pressure fuel pipe. Accordingly, even if the driving of the high-pressure pump causes the change in the fuel pressure in the high-pressure fuel pipe to propagate as the pulsation to the fuel in the low-pressure fuel pipe, the influence is restricted and an increase in the pulsation of the fuel pressure in the low-pressure fuel pipe is suppressed.

In the fuel supply device described above, the high-pressure pump may be configured to be driven by the internal combustion engine. In this case, the high-pressure pump may be in the operating state where the degree of influence of the pulsation of the fuel pressure propagating from the high-pressure fuel pipe on the fuel pressure in the low-pressure fuel pipe is high on condition that a rotation speed of the internal combustion engine is less than a predetermined determination value. The electronic control unit may be configured to execute the boost control when the rotation speed of the internal combustion engine is less than the predetermined determination value.

In the fuel supply device described above, the pulsation of the fuel pressure in the low-pressure fuel pipe is affected by the rotation speed of the internal combustion engine that drives the high-pressure pump. In other words, the period of the pulsation of the fuel pressure in the high-pressure fuel pipe is changed in accordance with the rotation speed of the internal combustion engine due to a periodic operation of the high-pressure pump based on the rotation of the internal combustion engine. When the pulsation of the fuel pressure in the high-pressure fuel pipe propagates with respect to the fuel in the low-pressure fuel pipe and the period of the pulsation becomes closer to the period of resonance with the fuel in the low-pressure fuel pipe, a resonance phenomenon causes the magnitude of the pulsation of the fuel pressure in the low-pressure fuel pipe to be maximized. In the fuel supply device, the rotation speed of the internal combustion engine at a time when the magnitude of the pulsation of the fuel pressure in the low-pressure fuel pipe has the maximum value as described above is, in general, designed to be present in the region of a rotation speed lower than an idle rotation speed. Accordingly, the pulsation of the fuel pressure in the low-pressure fuel pipe tends to increase as the rotation speed of the internal combustion engine decreases. Accordingly, according to the fuel supply device described above, an increase in the pulsation of the fuel pressure in the low-pressure fuel pipe can be suppressed, by executing the boost control for driving the feed pump to raise the fuel pressure in the low-pressure fuel pipe, when the rotation speed of the internal combustion engine has a low value that is less than the predetermined determination value.

In the fuel supply device described above, the electronic control unit may be configured to drive the feed pump and raise the fuel pressure in the low-pressure fuel pipe to a higher value, as the boost control, as the rotation speed of the internal combustion engine becomes lower than the predetermined determination value.

According to the design relationship of the fuel supply device described above, the pulsation of the fuel pressure in the low-pressure fuel pipe tends to increase, due to the propagation of the pulsation of the fuel pressure from the high-pressure fuel pipe to the fuel in the low-pressure fuel pipe, as the rotation speed of the internal combustion engine decreases. When the pulsation of the fuel pressure propagates from the high-pressure fuel pipe to the fuel in the low-pressure fuel pipe, the degree of the influence decreases as the fuel pressure in the low-pressure fuel pipe increases. Accordingly, according to the fuel supply device described above, an increase in the pulsation of the fuel pressure in the low-pressure fuel pipe can be effectively suppressed since the fuel pressure in the low-pressure fuel pipe is raised to a higher value as the rotation speed of the internal combustion engine becomes lower than the predetermined determination value.

In the fuel supply device described above, the electronic control unit may be configured to stop the boost control when fuel injection from the first fuel injection valve is not executed. When the fuel injection from the first fuel injection valve is not executed, the pulsation of the fuel pressure in the low-pressure fuel pipe does not affect the fuel injection amount of the first fuel injection valve. Accordingly, according to the fuel supply device described above, the energy that is consumed by the feed pump during the execution of the boost control can be saved by stopping the boost control.

In the fuel supply device described above, when the fuel injection from the first fuel injection valve is not executed the electronic control unit may be configured to (i) stop the boost control, and (ii) adjust the fuel pressure in the low-pressure fuel pipe to a minimum value at which vapor generation in the low-pressure fuel pipe can be suppressed. According to the fuel supply device described above, the fuel pressure in the low-pressure fuel pipe at a time when the fuel injection from the first fuel injection valve is not executed can be lowered to a minimum, and thus the amount of the energy that is consumed to ensure the fuel pressure can be lowered.

The fuel supply device may include a temperature sensor configured to detect the temperature of the fuel in the low-pressure fuel pipe. The electronic control unit may be configured to set the minimum value to a higher value as the temperature of the fuel detected by the temperature sensor increases. The fuel supply device may include a pressure sensor configured to detect the fuel pressure in the low-pressure fuel pipe. The electronic control unit may be configured to determine that the high-pressure pump is in the operating state when magnitude of the pulsation of the fuel pressure in the low-pressure fuel pipe detected by the pressure sensor is equal to or greater than a predetermined value. In the fuel supply device described above, the electronic control unit may be configured to increase the fuel pressure in the low-pressure fuel pipe as the magnitude of the pulsation of the fuel pressure propagating from the high-pressure fuel pipe increases when the high-pressure pump is in the operating state.

According to the fuel supply device described above, an increase in the pulsation of the fuel pressure in the low-pressure fuel pipe can be effectively suppressed based on the temperature of the fuel or/and the fuel pressure detected by the temperature sensor or/and the pressure sensor, and the amount of the energy that is consumed to ensure the fuel pressure can be lowered.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a fuel supply device for an internal combustion engine according to a first embodiment of the invention will be described with reference to FIGS. 1 to 3.

Figure 1:
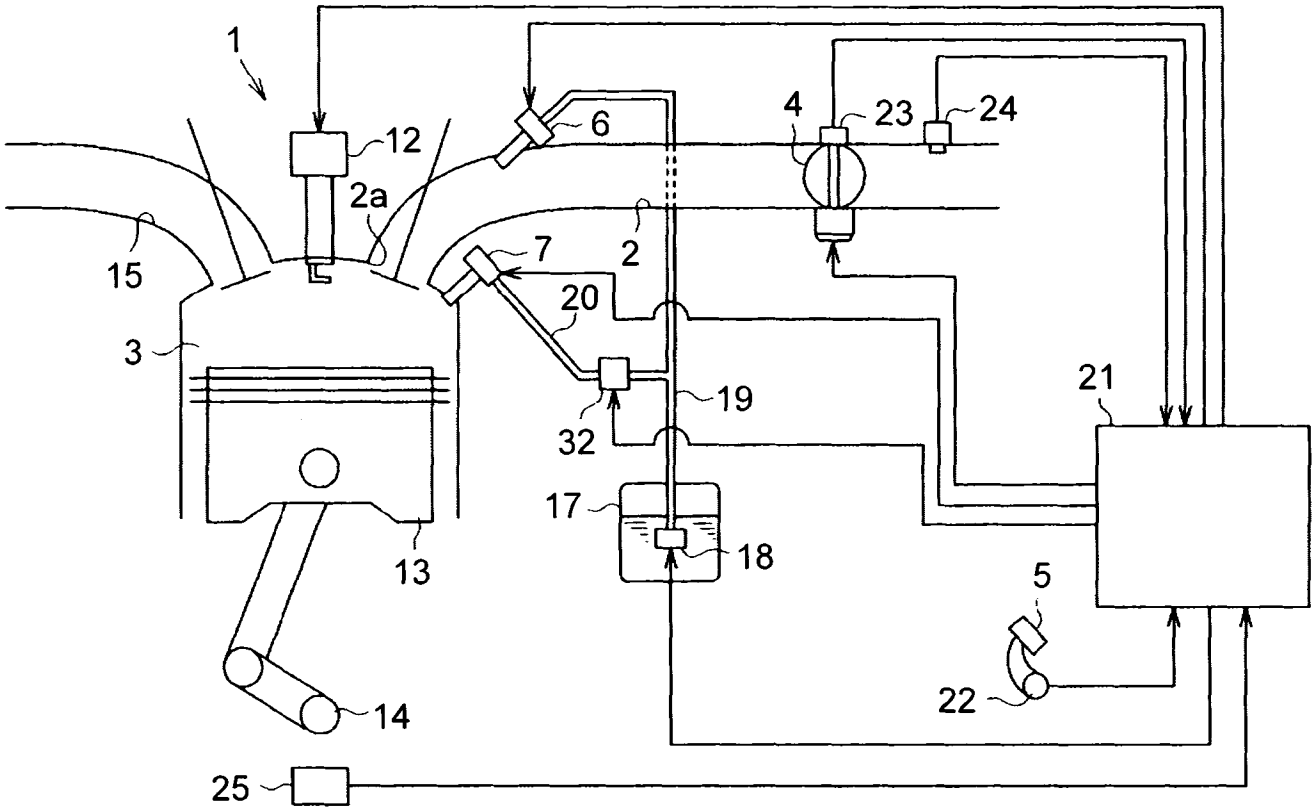
FIG. 1 is a schematic diagram illustrating an overall configuration of an internal combustion engine and a fuel supply device for the internal combustion engine according to embodiments of the invention.

An internal combustion engine 1 illustrated in FIG. 1 is mounted on a vehicle such as a car. A throttle valve 4, which is operated to be opened and closed so as to adjust the amount of air suctioned into a combustion chamber 3 (intake air amount), is disposed in an intake passage 2 of the internal combustion engine 1. The opening of the throttle valve 4 (throttle opening) is regulated in accordance with the amount of an operation on an accelerator pedal 5 (accelerator operation amount) that is subjected to a depressing operation by a driver of the vehicle.

In addition, the internal combustion engine 1 is provided with a port injection injector 6 for fuel injection toward an intake port 2*a* and a direct injection injector 7 for fuel injection into the combustion chamber 3 (into a cylinder).

The fuel is supplied to the port injection injector 6 and the direct injection injector 7 by the fuel supply device that is disposed in the internal combustion engine 1.

The fuel supply device for the internal combustion engine 1 is provided with a feed pump 18 that pumps up the fuel stored in a fuel tank 17 and discharges the fuel to a low-pressure fuel pipe 19. The low-pressure fuel pipe 19 is connected to the port injection injector 6. The port injection injector 6 functions as a first fuel injection valve that is connected to the low-pressure fuel pipe 19 which receives the supply of the fuel from the feed pump 18.

A high-pressure fuel pipe 20 is connected to the low-pressure fuel pipe 19. The high-pressure fuel pipe 20 is connected to the direct injection injector 7. The direct injection injector 7 functions as a second fuel injection valve that is connected to the high-pressure fuel pipe 20 which branches from the low-pressure fuel pipe 19. A high-pressure pump 32, which boosts the fuel in the pipe 20 and supplies the fuel to the direct injection injector 7, is disposed in the middle of the high-pressure fuel pipe 20. The high-pressure pump 32 is driven by a cam that rotates in response to the transmission of rotation from the internal combustion engine 1.

In the internal combustion engine 1, the combustion chamber 3 is filled with an air-fuel mixture of the fuel that is injected from at least one of the port injection injector 6 and the direct injection injector 7 and air that flows through the intake passage 2, and ignition by a spark plug 12 is executed with respect to the air-fuel mixture. The combustion energy that results from the combustion of the air-fuel mixture after the ignition allows a piston 13 to reciprocate. As a result, a crankshaft 14 rotates. After the combustion, the air-fuel mixture is sent to an exhaust passage 15 as exhaust gas.

The fuel supply device for the internal combustion engine 1 is provided with an electronic control unit 21 that executes various types of operation control for the internal combustion engine 1. The electronic control unit 21 is provided with, for example, a CPU that executes various types of computation processing relating to the various types of operation control, a ROM in which a program and data required for the control are stored, a RAM in which the result of the computation by the CPU and the like are temporarily stored, and an I/O port for signal input and output from and to the outside.

The following various sensors and the like are connected to the input port of the electronic control unit 21: accelerator position sensor 22 that detects the accelerator operation amount; throttle position sensor 23 that detects the throttle opening;

air flow meter 24 that detects the amount of the air which passes through the intake passage 2 (intake air amount in the internal combustion engine 1); and crank position sensor 25 that outputs a signal corresponding to the rotation of the crankshaft 14.

In addition, drive circuits for various instruments, such as the throttle valve 4, the port injection injector 6, the direct injection injector 7, the spark plug 12, the feed pump 18, and the high-pressure pump 32, and the like are connected to the output port of the electronic control unit 21.

The electronic control unit 21 discerns an operation state that is required for the internal combustion engine 1 and an actual operation state of the internal combustion engine 1 based on the signals input from the various sensors described above and the like, and outputs a command signal based thereon to the various drive circuits connected to the output port. In this manner, the various types of operation control for the internal combustion engine 1, such as throttle opening control, fuel injection amount control, ignition timing control, and fuel pressure control for the internal combustion engine 1, are carried out by the electronic control unit 21.

The electronic control unit 21 controls the fuel pressure in the low-pressure fuel pipe 19 and controls the fuel pressure in the high-pressure fuel pipe 20 based on the operation state that is required for the internal combustion engine 1 and the actual operation state of the internal combustion engine 1. The control of the fuel pressure in the low-pressure fuel pipe 19 is realized by determining a target fuel pressure Pt based on the operation state that is required for the internal combustion engine 1 and the actual operation state of the internal combustion engine 1 and driving the feed pump 18 based on the target fuel pressure Pt.

In the fuel supply device, the low-pressure fuel pipe 19 is connected to the high-pressure pump 32 via the high-pressure fuel pipe 20. Accordingly, when the fuel pressure in the high-pressure fuel pipe 20 changes as a result of the driving of the high-pressure pump 32, the changing fuel pressure propagates as pulsation to the fuel in the low-pressure fuel pipe 19. This causes the pulsation of the fuel pressure in the low-pressure fuel pipe 19 to increase.

An error from a proper value occurs in the fuel injection amount of the port injection injector 6 when the pulsation of the fuel pressure in the low-pressure fuel pipe 19 increases. This is because the fuel injection amount of the port injection injector 6 is determined by the valve opening time of the injector 6 and the fuel pressure supplied to the injector 6 (fuel pressure in the low-pressure fuel pipe 19). The error of the fuel injection amount of the port injection injector 6 described above may affect the operation of the internal combustion engine 1.

As a countermeasure, the electronic control unit 21 executes boost control for driving the feed pump 18 to raise the fuel pressure in the low-pressure fuel pipe 19 in an operating state of the high-pressure pump 32 where the degree of influence of the pulsation of the fuel pressure propagating from the high-pressure fuel pipe 20 on the fuel pressure in the low-pressure fuel pipe 19 is high. In this case, the electronic control unit 21 functions as a control unit for executing the boost control.

Figure 2:
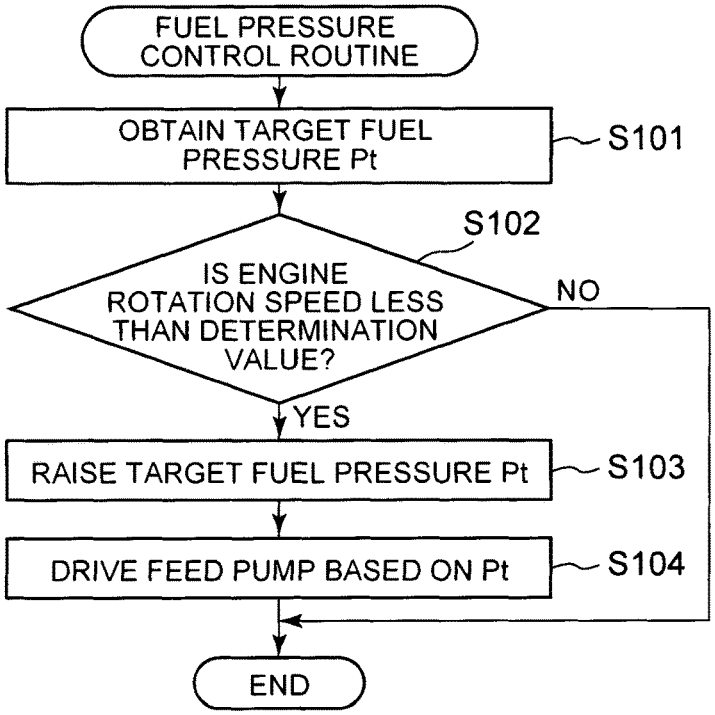
FIG. 2 is a flowchart illustrating a procedure for controlling the fuel pressure in a low-pressure fuel pipe according to a first embodiment of the invention.

FIG. 2 is a flowchart illustrating a fuel pressure control routine for executing the boost control. The fuel pressure control routine is, for example, periodically executed with the time interruption at each predetermined time by the electronic control unit 21.

The electronic control unit 21 obtains the target fuel pressure Pt, based on the operation state that is required for the internal combustion engine 1 and the actual operation state of the internal combustion engine 1, as the processing of Step 101 (S101) of this routine. The electronic control unit 21 determines, as the processing of Step S102, whether or not the rotation speed of the internal combustion engine that is obtained based on the detection signal from the crank position sensor 25 is less than a predetermined determination value. In the case of a negative determination herein, the processing proceeds to S103 and then to S104 (processing of S103 will be described later). As the processing of S104, the electronic control unit 21 adjusts the fuel pressure in the low-pressure fuel pipe 19 to the target fuel pressure Pt by driving the feed pump 18 based on the target fuel pressure Pt. After the execution of the processing of S104, the electronic control unit 21 temporarily terminates the fuel pressure control routine.

The processing of S102 is to determine whether or not the high-pressure pump 32 is in an operating state where the degree of influence of the pulsation of the fuel pressure propagating from the high-pressure fuel pipe 20 on the fuel pressure in the low-pressure fuel pipe 19 is high. It is for the following reason that it can be determined, based on the determination in S102 of whether or not the rotation speed of the internal combustion engine is less than the predetermined determination value, whether or not the high-pressure pump 32 is in the operating state where the degree of influence of the pulsation of the fuel pressure propagating from the high-pressure fuel pipe 20 on the fuel pressure in the low-pressure fuel pipe 19 is high.

The magnitude of the pulsation of the fuel pressure in the low-pressure fuel pipe 19 is affected by the rotation speed of the internal combustion engine 1 that drives the high-pressure pump 32. In other words, the period of the pulsation of the fuel pressure in the high-pressure fuel pipe 20 is changed in accordance with the rotation speed of the internal combustion engine due to a periodic operation of the high-pressure pump 32 based on the rotation of the internal combustion engine. When the pulsation of the fuel pressure in the high-pressure fuel pipe 20 propagates with respect to the fuel in the low-pressure fuel pipe 19 and the period of the pulsation becomes closer to the period of resonance with the fuel in the low-pressure fuel pipe 19, a resonance phenomenon causes the magnitude of the pulsation of the fuel pressure in the low-pressure fuel pipe 19 to be maximized. In the fuel supply device, the rotation speed of the internal combustion engine at a time when the magnitude of the pulsation of the fuel pressure in the low-pressure fuel pipe 19 has the maximum value as described above is designed to be present in the region of a rotation speed lower than an idle rotation speed. Accordingly, the pulsation of the fuel pressure in the low-pressure fuel pipe 19 tends to increase as the rotation speed of the internal combustion engine decreases.

Accordingly, when it is determined in S102 that the rotation speed of the internal combustion engine is less than a predetermined determination value, it can be determined that the high-pressure pump 32 is in an operating state where the degree of influence of the pulsation of the fuel pressure propagating from the high-pressure fuel pipe 20 on the fuel pressure in the low-pressure fuel pipe 19 is high. In other words, the predetermined determination value is set in advance, based on an experiment or the like, so that the determination can be executed by using the value.

When it is determined in S102 that the rotation speed of the internal combustion engine is less than a predetermined determination value, that is, when it is determined that the high-pressure pump 32 is in an operating state where the degree of influence of the pulsation of the fuel pressure propagating from the high-pressure fuel pipe 20 on the fuel pressure in the low-pressure fuel pipe 19 is high, the processing proceeds to S103. The processing of S103 is to execute the boost control described above. The electronic control unit 21 raises the target fuel pressure Pt, as the processing of S103, so that the target fuel pressure Pt has a value higher than the value obtained in S101.

Figure 3:
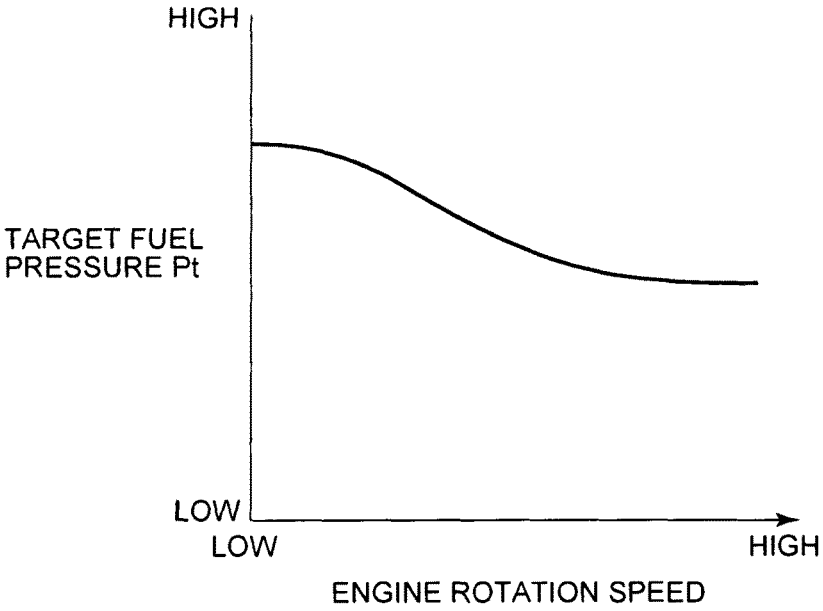
FIG. 3 is a graph illustrating how a target fuel pressure rises with respect to a decrease in the rotation speed of the internal combustion engine according to the first embodiment.

As illustrated in FIG. 3, the target fuel pressure Pt that is raised in S103 can be considered to be variably set so that the target fuel pressure Pt has a higher value as the rotation speed of the internal combustion engine decreases (more accurately, as the rotation speed of the internal combustion engine becomes less than the predetermined determination value). When the target fuel pressure Pt is raised to have a high value as described above, the feed pump 18 is driven based on the target fuel pressure Pt in the processing of S104, and thus the fuel pressure in the low-pressure fuel pipe 19 is adjusted to the target fuel pressure Pt. Accordingly, when the rotation speed of the internal combustion engine is less than the predetermined determination value, the fuel pressure in the low-pressure fuel pipe 19 is raised compared to when the rotation speed of the internal combustion engine is equal to or greater than the predetermined determination value.

Hereinafter, effects of the fuel supply device for the internal combustion engine 1 will be described. When the fuel pressure in the high-pressure fuel pipe 20 changes as a result of the driving of the high-pressure pump 32, the changing fuel pressure propagates as the pulsation to the fuel in the low-pressure fuel pipe 19. When the pulsation of the fuel pressure propagates from the high-pressure fuel pipe 20 to the fuel in the low-pressure fuel pipe 19 as described above, the degree of the influence decreases as the fuel pressure in the low-pressure fuel pipe 19 increases. In view of this, the fuel pressure in the low-pressure fuel pipe 19 is raised, through the execution of the boost control by the electronic control unit 21 (more specifically, rise of the target fuel pressure Pt to a higher value), when the high-pressure pump 32 is in an operating state where the degree of influence of the pulsation of the fuel pressure propagating from the high-pressure fuel pipe 20 on the fuel pressure in the low-pressure fuel pipe 19 is high. When the fuel pressure in the low-pressure fuel pipe 19 is raised in this manner, the driving of the high-pressure pump 32 causes the fuel pressure in the high-pressure fuel pipe 20 to change. As a result, the degree of the influence is restricted when the pulsation of the fuel pressure propagates from the high-pressure fuel pipe 20 to the fuel in the low-pressure fuel pipe 19. Accordingly, even if the driving of the high-pressure pump 32 causes the change in the fuel pressure in the high-pressure fuel pipe 20 to propagate as the pulsation to the fuel in the low-pressure fuel pipe 19, the influence is restricted and an increase in the pulsation of the fuel pressure in the low-pressure fuel pipe 19 is suppressed.

The following effects can be achieved by this embodiment described above.

(1) An increase in the pulsation of the fuel pressure in the low-pressure fuel pipe 19 that is attributable to the driving of the high-pressure pump 32 can be suppressed. In addition, the occurrence of an error from a proper value in the fuel injection amount of the port injection injector 6 that is attributable to an increase in the pulsation, which causes the air-fuel ratio of the internal combustion engine 1 to deviate from a proper ratio to affect exhaust emission, can be suppressed. In addition, the influence on the exhaust emission that is attributable to the deviation of the air-fuel ratio of the internal combustion engine 1 from a proper ratio can be minimized, and thus the amount of the catalyst precious metal for exhaust gas control that is disposed in an exhaust system of the engine 1 for exhaust emission improvement can be reduced.

(2) When the fuel pressure in the low-pressure fuel pipe 19 is raised by executing the boost control based on the determination that the rotation speed of the internal combustion engine is less than a predetermined determination value, the target fuel pressure Pt is raised so as to realize the rise in the fuel pressure. The target fuel pressure Pt that is raised in this manner is variably set to have a higher value as the rotation speed of the internal combustion engine becomes lower than the predetermined determination value. In this manner, the fuel pressure in the low-pressure fuel pipe 19 is adjusted to be raised to a higher value as the rotation speed of the internal combustion engine becomes lower than the predetermined determination value. When the pulsation of the fuel pressure from the high-pressure fuel pipe 20 based on a periodic operation of the high-pressure pump 32 propagates to the fuel in the low-pressure fuel pipe 19, the degree of the influence decreases as the fuel pressure in the low-pressure fuel pipe 19 increases. Accordingly, an increase in the pulsation of the fuel pressure in the low-pressure fuel pipe 19 can be effectively suppressed, by increasing the fuel pressure in the low-pressure fuel pipe 19, as the rotation speed of the internal combustion engine becomes lower than the predetermined determination value as described above.

(3) The boost control is not executed when the rotation speed of the internal combustion engine is equal to or greater than a predetermined determination value. The boost control is executed when necessary, for example, when the rotation speed of the internal combustion engine is less than the predetermined determination value. Accordingly, the driving of the feed pump 18 for raising the fuel pressure in the low-pressure fuel pipe 19 during the boost control is not executed in vain. Accordingly, wasteful energy consumption can be suppressed in the feed pump 18, and fuel economy deterioration can be suppressed in the internal combustion engine 1 by the same amount.

Hereinafter, a fuel supply device for an internal combustion engine according to a second embodiment of the invention will be described with reference to FIGS. 4 and 5.

Figure 4:
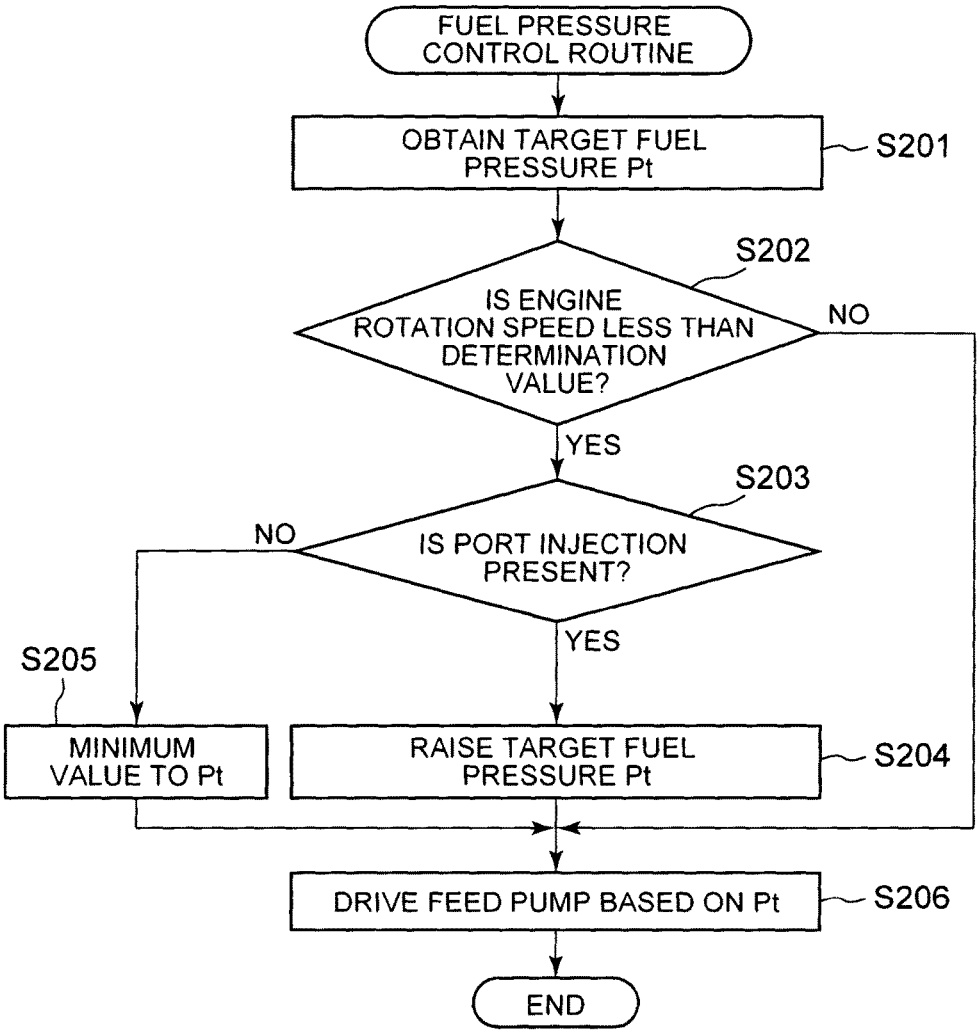
FIG. 4 is a flowchart illustrating a procedure for controlling the fuel pressure in a low-pressure fuel pipe according to a second embodiment of the invention.

FIG. 4 is a flowchart illustrating a fuel pressure control routine according to the second embodiment. In this fuel pressure control routine, the processing of S203 and S205 are added to the processing (S201, S202, S204, and S206) corresponding to S101 to S104 of the fuel pressure control routine according to the first embodiment that is illustrated in FIG. 2. The processing of S203 and S205 are to stop the boost control in a case where the fuel injection from the port injection injector 6 is not executed with the rotation speed of the internal combustion engine being less than a predetermined determination value.

The fuel pressure control routine in FIG. 4 is also periodically executed with the time interruption at each predetermined time by the electronic control unit 21. The electronic control unit 21 obtains the target fuel pressure Pt as the processing of S201 and determines, as the processing of S202, whether or not the rotation speed of the internal combustion engine is less than a predetermined determination value. The processing proceeds to S206 in the case of a negative determination herein. The electronic control unit 21 drives the feed pump 18 based on the target fuel pressure Pt as the processing of S206, and then temporarily terminates this fuel pressure control routine.

The processing proceeds to S203 in a case where it is determined in S202 that the rotation speed of the internal combustion engine is less than a predetermined determination value. As the processing of S203, the electronic control unit 21 determines whether or not the fuel injection from the port injection injector 6 is executed. The processing proceeds to S204 in the case of a positive determination herein. As the processing of S205, the electronic control unit 21 raises the target fuel pressure Pt to have a value higher than the value obtained in S201, and drives the feed pump 18 based on the raised target fuel pressure Pt as the processing of S206. Then, the boost control is executed.

The processing proceeds to S205 in a case where it is determined in S203 that the fuel injection from the port injection injector 6 is not executed. As the processing of S205, the electronic control unit 21 sets the target fuel pressure Pt to the minimum value of the fuel pressure at which vapor generation in the low-pressure fuel pipe 19 can be suppressed. A fixed value that is determined in advance in an experiment or the like can be adopted as the minimum value. Also, a variable value based on the temperature of the fuel in the low-pressure fuel pipe 19 can be adopted as the minimum value.

Figure 5:
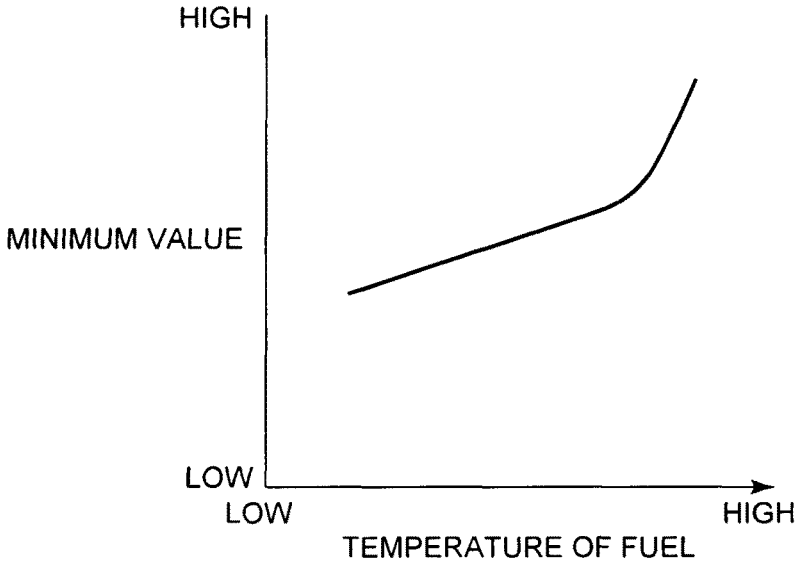
FIG. 5 is a graph illustrating a change in the minimum value of the fuel pressure at which no vapor is generated with respect to a change in the temperature of the fuel in the low-pressure fuel pipe according to the second embodiment.

FIG. 5 illustrates an example of how the minimum value rises with respect to a rise in the temperature of the fuel in a case where the minimum value is allowed to be variable based on the temperature of the fuel in the low-pressure fuel pipe 19. It is considered that a value that is actually measured by a temperature sensor which detects the temperature of the fuel or a value that is estimated based on a parameter relating to the temperature of the fuel can be used regarding the temperature of the fuel used herein.

After the target fuel pressure Pt is set to the minimum value in S203, the feed pump 18 is driven based on the target fuel pressure Pt (minimum value) through the processing of S206. Accordingly, in a case where the fuel injection from the port injection injector 6 is not executed, the execution of the boost control is stopped, based on the fact that the fuel injection from the port injection injector 6 is not executed, even if the rotation speed of the internal combustion engine is less than a predetermined determination value. In addition, when the boost control is stopped as described above, the fuel pressure in the low-pressure fuel pipe 19 is adjusted to the minimum value of the fuel pressure at which the vapor generation in the pipe 19 can be suppressed.

Accordingly, the following effects can be achieved, in addition to the effects (1) to (3) of the first embodiment, according to this embodiment.

(4) When the fuel injection from the port injection injector 6 is not executed, the pulsation of the fuel pressure in the low-pressure fuel pipe 19 does not affect the fuel injection amount of the port injection injector 6. In this situation, the execution of the boost control is stopped, based on the situation, even if the rotation speed of the internal combustion engine is less than a predetermined determination value. Accordingly, the energy that is consumed when the feed pump 18 is driven during the execution of the boost control can be saved.

(5) When the fuel injection from the port injection injector 6 is not executed, the boost control is stopped and the fuel pressure in the low-pressure fuel pipe 19 is adjusted to the minimum value at which the vapor generation in the pipe 19 can be suppressed. Then, the fuel pressure in the low-pressure fuel pipe 19 at a time when the fuel injection from the port injection injector 6 is not executed can be lowered to a minimum, and thus the amount of the energy that is consumed when the feed pump 18 is driven to ensure the fuel pressure can be lowered.

Each of the embodiments described above can be modified as follows as, for example, another embodiment.

In the second embodiment, the target fuel pressure Pt does not necessarily have to be set to the minimum value when the boost control is stopped based on the fact that the fuel injection from the port injection injector 6 is not executed. In this case, for example, the target fuel pressure Pt may be set to the value that is obtained in S201 of the fuel pressure control routine in FIG. 4.

In the first and second embodiments, the pressure sensor that detects the fuel pressure in the low-pressure fuel pipe 19 is disposed and the magnitude (amplitude) of the pulsation of the fuel pressure is obtained based on the detection signal from the pressure sensor. It may be determined that the high-pressure pump 32 is in an operating state where the degree of influence of the pulsation of the fuel pressure propagating from the high-pressure fuel pipe 20 on the fuel pressure in the low-pressure fuel pipe 19 is high when the magnitude of the pulsation of the fuel pressure in the low-pressure fuel pipe 19 is equal to or greater than a predetermined value.

In a case where the magnitude of the pulsation of the fuel pressure in the low-pressure fuel pipe 19 is detected by using the pressure sensor, it is preferable that the target fuel pressure Pt is raised based on the magnitude of the detected pulsation in the processing of S103 of the fuel pressure control routine in FIG. 2 and the processing of S204 of the fuel pressure control routine in FIG. 4.

Figure 6:
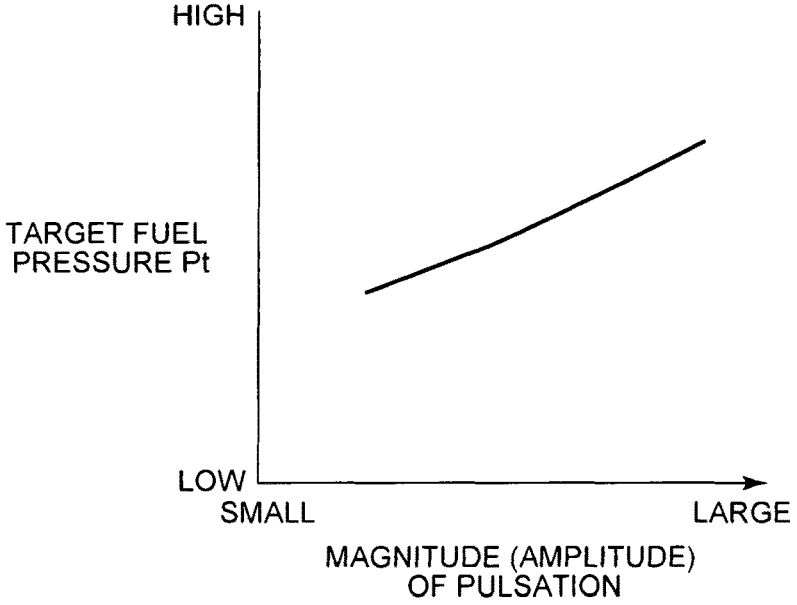
FIG. 6 is a graph illustrating a change in a target fuel pressure with respect to the magnitude of the pulsation of the fuel pressure in a low-pressure fuel pipe according to an example of another embodiment.

FIG. 6 is a graph illustrating a relationship between the magnitude of the pulsation of this case and the target fuel pressure Pt. As is apparent from the drawing, the target fuel pressure Pt that is raised in the processing of S103 and S204 is raised to have a higher value as the magnitude of the pulsation increases.

If it is determined whether or not the high-pressure pump 32 is in an operating state where the degree of influence of the pulsation of the fuel pressure propagating from the high-pressure fuel pipe 20 on the fuel pressure in the low-pressure fuel pipe 19 is high based on whether or not the rotation speed of the internal combustion engine is less than a low rotation determination value as in the first embodiment and the second embodiment, the pressure sensor can be omitted and the fuel supply device can be simplified.

When the target fuel pressure Pt is raised in the processing of S103 of the fuel pressure control routine in FIG. 2 and the processing of S204 of the fuel pressure control routine in FIG. 4, the rise in the target fuel pressure Pt may be realized by using a rise by a predetermined fixed value.

The invention claimed is:

1. A fuel supply device for an internal combustion engine, the fuel supply device comprising:

a low-pressure fuel pipe connected to a first fuel injection valve of an internal combustion engine, the low-pressure fuel pipe being configured to receive fuel supplied from a feed pump;

a high-pressure fuel pipe branching from the low-pressure fuel pipe, the high-pressure fuel pipe being connected to a second fuel injection valve of the internal combustion engine;

a high-pressure pump configured to boost the fuel in the high-pressure fuel pipe, the high-pressure pump being configured to supply the fuel to the second fuel injection valve;

a pressure sensor configured to detect a fuel pressure and a magnitude of pulsation of the fuel pressure in the low-pressure fuel pipe; and an electronic controller configured to execute boost control in an operating state of the high-pressure pump where a degree of influence of pulsation of fuel pressure propagating from the high-pressure fuel pipe on the fuel pressure in the low-pressure fuel pipe is greater than a predetermined value, the degree of influence of pulsation being a degree to which the fuel pressure propagating from the high-pressure fuel pipe causes the fuel pressure in the low-pressure fuel pipe to pulsate, the boost control driving the feed pump in order to raise the fuel pressure in the low-pressure fuel pipe such that the fuel pressure is higher when the degree of influence of pulsation is greater than the predetermined value than when the degree of influence of pulsation is equal to or less than the predetermined value.

2. The fuel supply device according to claim 1, wherein the electronic controller is configured to increase the fuel pressure in the low-pressure fuel pipe as the degree of influence of the pulsation of the fuel pressure propagating from the high-pressure fuel pipe increases when the high-pressure pump is in the operating state.

3. The fuel supply device according to claim 1, wherein the high-pressure pump is configured to be driven by the internal combustion engine and the high-pressure pump is in the operating state where the degree of influence of the pulsation of the fuel pressure propagating from the high-pressure fuel pipe on the fuel pressure in the low-pressure fuel pipe is greater than the predetermined value under a condition that a rotation speed of the internal combustion engine is less than a predetermined determination value, and the electronic controller is configured to execute the boost control when the rotation speed of the internal combustion engine is less than the predetermined determination value.

4. The fuel supply device according to claim 3, wherein the electronic controller is configured to drive the feed pump and raise the fuel pressure in the low-pressure fuel pipe to a higher value, as the boost control, as the rotation speed of the internal combustion engine becomes lower than the predetermined determination value.

5. The fuel supply device according to claim 1, wherein the electronic controller is configured to stop the boost control when fuel injection from the first fuel injection valve is not executed.

6. The fuel supply device according to claim 5, wherein when the fuel injection from the first fuel injection valve is not executed, the electronic controller is configured to (i) stop the boost control, and (ii) adjust the fuel pressure in the low-pressure fuel pipe to a minimum value at which vapor generation in the low-pressure fuel pipe can be suppressed.

7. The fuel supply device according to claim 6, further comprising a temperature sensor configured to detect the temperature of the fuel in the low-pressure fuel pipe, wherein the electronic controller is configured to set the minimum value to a higher value as the temperature of the fuel detected by the temperature sensor increases.

8. The fuel supply device according to claim 1, wherein the electronic controller is configured to determine that the high-pressure pump is in the operating state when the magnitude of the pulsation of the fuel pressure in the low-pressure fuel pipe detected by the pressure sensor is equal to or greater than a predetermined value.

9. The fuel supply device according to claim 8, wherein the electronic controller is configured to increase the fuel pressure in the low-pressure fuel pipe as the magnitude of the pulsation of the fuel pressure propagating from the high-pressure fuel pipe increases when the high-pressure pump is in the operating state.

* * * * *